United States Patent [19]

Zupanovich et al.

[11] Patent Number: 4,895,703

[45] Date of Patent: Jan. 23, 1990

[54] TRIHYDROXYBENZENE BOILER CORROSION INHIBITOR COMPOSITIONS AND METHOD

[75] Inventors: John D. Zupanovich, Pittsburgh; Lois J. Neil, Sewickley; Dennis J. Sepelak, McMurray, all of Pa.

[73] Assignee: Calgon Corporation, Pittsburgh, Pa.

[21] Appl. No.: 232,354

[22] Filed: Aug. 15, 1988

Related U.S. Application Data

[63] Continuation of Ser. No. 92,342, Sep. 3, 1987, abandoned, which is a continuation of Ser. No. 2,836, Jan. 13, 1987, abandoned, which is a continuation of Ser. No. 776,935, Sep. 17, 1985, abandoned.

[51] Int. Cl.[4] ..... C23F 11/00

[52] U.S. Cl. ..... 422/14; 422/11; 252/188.28; 252/393; 252/178; 210/750; 210/757

[58] Field of Search ..... 252/188.28, 393, 178; 422/11, 14; 210/750, 757

[56] References Cited

U.S. PATENT DOCUMENTS

| | | | |
|---|---|---|---|
| 3,551,349 | 12/1970 | Kalfass | 252/392 |
| 3,843,547 | 10/1974 | Kaufman et al. | 252/188.28 |
| 4,096,090 | 6/1978 | Noack | 252/400.53 X |
| 4,278,635 | 7/1981 | Kerst | 422/14 |
| 4,279,767 | 7/1981 | Muccitelli | 252/178 |
| 4,282,111 | 8/1981 | Ciuba | 252/178 |
| 4,289,645 | 9/1981 | Muccitelli | 252/188.28 X |
| 4,487,708 | 12/1984 | Muccitelli | 252/178 |

FOREIGN PATENT DOCUMENTS

| | | | |
|---|---|---|---|
| 127064 | 12/1984 | European Pat. Off. | 422/16 |
| 204288 | 12/1982 | Japan | 252/188.28 |
| 2138796 | 10/1984 | United Kingdom | 422/19 |
| 2160877 | 1/1986 | United Kingdom | 252/404 |

OTHER PUBLICATIONS

Chemical Abstract No. 91:59488, vol. 91 (1979) p. 142, "Deoxidant Chip of High Activity".

*Kirk-Othmer Encyclopedia of Chemical Technology* Third Edition, (1984), vol. 24, John Wiley & Sons, pp. 379–380.

*Kirk-Othmer Encyclopedia of Chemical Technology* Third Edition, (1982), vol. 18, John Wiley & Sons, pp. 680–681.

*Primary Examiner*—Matthew A. Thexton

*Attorney, Agent, or Firm*—W. C. Mitchell; M. C. Sudol, Jr.

[57] ABSTRACT

A method for inhibiting corrosion due to dissolved oxygen wherein trihydroxybenzene compounds, alone or in combination with conventional oxygen scavengers, preferably hydroquinone, are added to boiler water to prevent corrosion by reducing dissolved oxygen levels in boiler feedwater.

2 Claims, No Drawings

TRIHYDROXYBENZENE BOILER CORROSION INHIBITOR COMPOSITIONS AND METHOD

This is a continuation, of application Ser. No. 092,342, filed Sept. 3, 1987, now abandoned, which is a continuation of application Ser. No. 002,836, filed Jan. 13, 1987, now abandoned, which is a continuation of application Ser. No. 776,935, filed Sept. 17, 1985, now abandoned.

BACKGROUND OF THE INVENTION

This invention relates to a method for inhibiting corrosion in boiler feedwater systems and boilers due to dissolved oxygen comprising adding to the boiler feedwater an effective amount of at least one trihydroxybenzene compound, alone or in combination with conventional boiler corrosion inhibitors such as hydroquinone, methoxypropylamine, cyclohexylamine, diethylethanolamine, morpholine, diethyl hydroxylamine, dimethyl amino-2-propanol, 2-amino 2-methylpropanol, carbohydrazide, erythorbic acid, and salts of erythorbic acid, or in combination with catalysts such as cobalt.

More particularly, this invention relates to the use of pyrogallol, alone or in combination with conventional boiler corrosion inhibitors, to control corrosion in boiler feedwater systems and boilers.

Protection of boiler feedwater systems is becoming an increasingly important aspect of plant operation. The presence of dissolved oxygen in boiler feed water is a primary cause of waterside corrosion. In these energy-conscious times, an increase in the quality of boiler feedwater results in cost savings for the total boiler system.

Historically, the action of dissolved gases such as oxygen and carbon dioxide have been two of the main factors that lead to feedwater system and boiler corrosion. In order to understand the role of dissolved gases in corrosion, one must understand the electrochemical nature of corrosion. Under most conditions, there is a tendency for iron to dissolve in water, and two electrons are released for each iron atom that dissolves. These electrons transfer to hydrogen ions present in the water, and the ions are reduced to elemental gaseous hydrogen. All action ceases at this point if the hydrogen remains on the surface of the metal since a protective coating forms with the passage of electrons. However, any agent which increases the number of hydrogen ions present in the water, or which will cause the removal of the protective film, serves to increase the rate of corrosion.

The presence of oxygen in boiler feedwater causes a two-fold reaction to occur. Some molecules of oxygen combine with displaced hydrogen, thereby exposing the metal to fresh attack. Other oxygen molecules combine with iron ions to form insoluble iron oxide compounds.

The first product of corrosion may be ferric oxide, which is only loosely adherent and aggravates corrosion by blocking off areas to oxygen access. These areas become anionic and iron oxide couples are set up. The iron under the oxide deposit then dissolves, and pitting develops.

With respect to oxygen, the severity of attack will depend on the concentration of dissolved oxygen in the water, water pH and temperature. As water temperature increases, corrosion in feed lines, heaters, boilers, steam and return lines made of iron and steel increases.

The inventors have discovered a new improved method for control of corrosion in boiler feedwater systems and boilers.

A major approach to reducing oxygen in boiler feedwater is mechanical deaeration. Efficient mechanical deaeration can reduce dissolved oxygen to as low as 5–10 ppb in industrial plants and 2–3 ppb in utility operations. However, even with this trace amount of oxygen, some corrosion may occur in boilers. Removal of the last traces of oxygen from boiler feedwater is generally accomplished by the addition of chemicals that react with oxygen and which are hereinafter referred to as oxygen scavengers.

Several oxygen scavengers are known in the art. Widely used oxygen scavengers include, but are not limited to, sodium sulfite, hydrazine, diethylhydroxylamine, carbohydrazide and hydroquinone. U.S. Pat. No. 3,551,349 discloses the use of quinones, particularly hydroquinone, as catalysts for the hydrazine-oxygen reaction. U.S. Pat. No. 4,096,090 discloses the use of hydrazine compounds, a catalytic organometallic complex, and preferably a quinone compound for deoxygenating feedwater U.S Pat. No. 3,808,138 discloses the use of cobalt maleic acid hydrazide with hydrazine for oxygen removal. U.S. Pat. No. 3,962,113 discloses the use of organic hydrazine such as monoalkyl hydrazine, dialkyl hydrazine and trialkyl hydrazine as oxygen scavengers.

Disadvantages of hydrazine and related compounds include toxicity and suspected carcinogenic effects. Hydrazine is toxic if inhaled, and is also an irritant to the eyes and skin.

Carbohydrazide, a derivative of hydrazine, decomposes to form hydrazine and carbon dioxide at temperatures above 360° F. U.S. Pat. No. 4,269,717 discloses the use of carbohydrazide as an oxygen scavenger and metal passivator.

U.S. Pat. Nos. 4,278,635 and 4,282,111 disclose the use of hydroquinone, among other dihydroxy, diamino and amino hydroxy benzenes, as oxygen scavengers. U.S. Pat. Nos. 4,279,767 and 4,487,708 disclose the use of hydroquinone and "mu-amines", which are defined as amines which are compatible with hydroquinone. Methoxypropylamine is a preferred mu-amine U.S. Pat. No. 4,363,734 discloses the use of catalyzed 1,3-dihydroxy acetone as an oxygen scavenger. U.S. Pat. No. 4,419,327 discloses the use of amine or ammonia neutralized erythorbates as oxygen scavengers. Additionally, diethylhydroxylamine (DEHA) has been used as an oxygen scavenger, and U.S. Pat. No. 4,192,844 discloses the use of methoxypropylamine and hydrazine as a corrosion inhibiting composition. European Patent number 0054345 discloses the use of amino-phenol compounds or acid addition salts thereof as oxygen scavengers.

UK patent application No. 2138796A discloses the use of trivalent phenols, preferably pyrogallol, to improve the activity of hydrazine-trivalent cobalt compositions.

DETAILED DESCRIPTION OF THE INVENTION

The instant invention is directed to a method for control of corrosion in boilers and boiler feedwater systems comprising adding to boiler feedwater containing dissolved oxygen an effective amount of at least one trihydroxy benzene compound and, optionally, a second oxygen scavenger or neutralizing amine selected from the group consisting of hydroquinone, methoxypropylamine, cyclohexylamine, diethylethanolamine, morpholine, diethyl hydroxylamine, dimethyl amino-2-propanol, 2-amino 2-methylpropanol, carbohydrazide, erythorbic acid, and salts of erythorbic acid. The preferred salt of erythorbic acid is sodium erythorbate.

The instant invention is also directed to corrosion inhibiting compositions comprising: a) at least one trihydroxy benzene compound; and b) a compound selected from the group consisting of hydroquinone, methoxypropylamine, cyclohexylamine, diethylethanolamine, morpholine, diethyl hydroxylamine, dimethyl amino-2-propanol, carbohydrazide, 2-amino 2-methylpropanol, erythorbic acid, and salts of erythorbic acid.

Any trihydroxy benzene compound can be used. Examples include 1,2,3-trihydroxy benzene (pyrogallol), 1,2,4-trihydroxy benzene (benzene triol), and 1,3,5-trihydroxy benzene (phloroglucinol). The preferred trihydroxy benzene compounds are pyrogallol and benzene triol, with the most preferred compound being pyrogallol.

Optionally, the trihydroxy benzene compounds may be used in combination with each other or with other known corrosion inhibitors, including but not limited to filming amines and neutralizing amines.

Preferred compounds for use with trihydroxy benzene compounds are selected from the group consisting of: hydroquinone, carbohydrazide, diethylhydroxylamine, erythorbic acid, and salts of erythorbic acid, especially sodium erythorbate. The most preferred compounds are hydroquinone and diethylhydroxylamine. Though trihydroxy benzene compounds can be combined with hydrazine, such a combination is not preferred because of the toxic qualities of hydrazine.

The trihydroxy benzene compounds of the instant invention may be used at any effective dosage. As used herein, the term "effective amount" is that amount which inhibits corrosion in the system being treated. The preferred dosage is from about 0.1 to about 1,000 parts per million in the feedwater being treated, more preferably from about 1 to about 100 parts per million. The preferred mol ratio of trihydroxybenzene:dissolved $O_2$ ranges from 0.01:1.0 to 100:1, with the most preferred mol ratio ranging from 0.1:1 to 20:1.

When used in combination with a second corrosion inhibitor, the weight ratio of the trihydroxy benzene compound to the second compound should be from 1:99 to 99:1, by weight, preferably 1:50 to 50:1 and most preferably 10:1 to 1:10. At least about 0.1 ppm to about 1,000 ppm of the composition should be added. The preferred dosage is 1 to 100 ppm of the composition.

The compositions of this invention may be fed to the boiler feedwater by any means known in the art. Thus, the instant compositions may be pumped into boiler feedwater tanks or lines, or added by some other suitable means. Though for convenience purposes it is recommended that the trihydroxy benzene compound and the second corrosion inhibitor, if used, be added as a composition, they may be added separately without departing from the spirit or scope of this invention.

EXAMPLES

The following examples further illustrate the invention. They should not be construed as in any way limiting the invention.

EXAMPLES 1–11

Examples 1–11 show the oxygen scavenging capability of pyrogallol. Pyrogallol, at the concentration indicated in Table I, was added to a simulated boiler feedwater at a pH of 9.0 and at the temperature shown. Percent oxygen removal values after 2, 4, 6, 8 and 10 minutes are shown in Table I below.

TABLE I

| Ex. No. | Dosage (ppm) | Mol. Ratio Pyrogallol:$O_2$ | Weight Ratio Pyrogallol:$O_2$ | Temperature (Degrees C.) | % $O_2$ Removal v. Time 2 min. | 4 min. | 6 min. | 8 min. | 10 min. |
|---|---|---|---|---|---|---|---|---|---|
| 1 | 40 | 1.1:1 | 4.5:1 | 20 | 7.4 | 12.5 | 15.3 | 16.5 | 17.6 |
| 2 | 20 | .64:1 | 2.5:1 | 29 | 69.3 | 80.7 | 83.8 | 84.8 | 84.8 |
| 3 | 10 | .32:1 | 1.3:1 | 33 | 51.6 | 55.0 | 55.4 | 54.6 | 54.2 |
| 4 | 5 | .17:1 | .65:1 | 31 | 25.0 | 26.2 | 28.2 | 28.2 | 26.2 |
| 5 | 20 | .94:1 | 3.6:1 | 51.3 | 61.8 | 70.2 | 73.4 | 74.5 | 75.2 |
| 6 | 10 | .4:1 | 1.6:1 | 50 | 43.6 | 51.2 | 54.9 | 54.5 | 55.0 |
| 7 | 20 | .8:1 | 3.1:1 | 50 | 44.2 | 54.3 | 55.3 | 57.8 | 58.6 |
| 8 | 20 | .9:1 | 3.8:1 | 48.7 | 47.6 | 57.0 | 60.7 | 62.3 | 63.5 |
| 9 | 10 | .53:1 | 2.1:1 | 57.2 | 38.0 | 46.4 | 50.4 | 51.9 | 51.9 |
| 10 | 5 | .24:1 | .94:1 | 49.8 | 30.8 | 31.7 | 30.8 | 34.9 | 35.9 |
| 11 | 20 | .94:1 | 3.7:1 | 48.5 | 40.0 | 48.8 | 52.6 | 54.7 | 55.7 |

EXAMPLES 12–14

Examples 12-14 show the oxygen scavenging capability of 1,2,4-trihydroxybenzene (benzene triol). Benzene triol was added to simulated boiler feedwater at pH 9, and at the temperatures and dosages shown. Percent oxygen removal values after 2, 4, 6, 8 and 10 minutes are shown in Table II, below.

TABLE II

| Ex. No. | Dosage (ppm) | Mol. Ratio Benzene Triol | Weight Ratio Benzene Triol | Temperature (Degrees C.) | % $O_2$ Removal v. Time 2 min. | 4 min. | 6 min. | 8 min. | 10 min. |
|---|---|---|---|---|---|---|---|---|---|
| 12 | 65 | 4:1 | 15.1:1 | 54 | 95.6 | 98.3 | 98.0 | 99.5 | 97.7 |
| 13 | 20 | 1.1:1 | 4.2:1 | 48.3 | 54.8 | 64.2 | 65.9 | 65.7 | 66.6 |
| 14 | 10 | 0.5:1 | 2:1 | 50 | 38.2 | 38.2 | 38.5 | 37.6 | 37.9 |

EXAMPLES 15–32

These examples compare the oxygen scavenging capabilities of several well-known oxygen scavengers with those of compositions comprising pyrogallol and a second conventional oxygen scavenger. Results are shown in Table III, below.

TABLE III

| Ex.* No. | $O_2$ Scavenger | Dosage (ppm) | Mol. Ratio Scavenger:$O_2$ | Weight Ratio Scavenger:$O_2$ | Temperature (Degrees C.) | % $O_2$ Removal v. Time 2 min. | 4 min. | 6 min. | 8 min. | 10 min. |
|---|---|---|---|---|---|---|---|---|---|---|
| 15 | Resorcinol | 25 | .79:1 | 2.7:1 | 22.5 | 0. | 1.3 | 1.9 | 2.4 | 2.7 |
| 16 | Diethylhydroxyamine (85%) | 25 | 1.1:1 | 2.8:1 | 22.5 | 2.7 | 5.6 | 8.4 | 9.9 | 12.5 |
| | | 38.2 | 1.5:1 | 4.1:1 | 19.0 | 1.3 | 2.3 | 4.0 | 4.4 | 5.3 |
| | | 38.2 | 1.7:1 | 4.6:1 | 31.3 | 36.4 | 58.7 | 71.1 | 78.9 | 83.3 |
| | | 34 | 1.46:1 | 4.1:1 | 33.0 | 42.1 | 62.4 | 73.7 | 79.6 | 82.4 |
| | | 34 | 2.4:1 | 6.8:1 | 48.4 | 61.9 | 85.3 | 93.4 | 95.6 | 96.1 |
| | | 17 | .76:1 | 2.1:1 | 31.0 | 18.5 | 31.3 | 38.7 | 43.4 | 46.2 |
| | | 34 | 2:1 | 5.7:1 | 51.0 | 14.1 | 27.8 | 38.6 | 47.3 | 54.5 |
| | | 34 | 2.2:1 | 6.1:1 | 51.0 | 20.2 | 36.3 | 48.1 | 56.2 | 62.2 |
| 17 | Hydroquinone | 25 | .88:1 | 3:1 | 22.7 | 22.5 | 39.0 | 47.3 | 52.2 | 54.9 |
| | | 10 | .32:1 | 1.1:1 | 21 | 31.4 | 32.5 | 32.1 | 31.5 | 31.4 |
| | | 5 | .21:1 | .64:1 | 32 | 15.0 | 17.7 | 16.4 | 15.4 | 15.7 |
| | | 10 | .34:1 | 1.3:1 | 30 | 33.8 | 34.9 | 34.6 | 34.6 | 33.3 |
| | | 20 | .72:1 | 2.5:1 | 30 | 63.6 | 68.5 | 68.5 | 67.6 | 66.7 |
| 18 | Hydrazine | 9.5 | 1:1 | 1.1:1 | 21 | 1.1 | 1.1 | 1.1 | 2.2 | 2.2 |
| 19 | Sodium Sulfite | 78.4 | 2.2:1 | 8.9:1 | 21 | 1.3 | 6.2 | 11.8 | 16.2 | 21.2 |
| 20 | 2-Methyl Resorcinol | 40 | .1:1 | 4.5:1 | 20 | — | — | — | — | 0.26 |
| 21 | Catechol | 40 | 1.3:1 | 4.5:1 | 20 | — | — | — | — | 1.9 |
| | | 20 | .69:1 | 2.4:1 | 31 | 10 | 19.6 | 25.6 | 31.0 | 33.8 |
| 22 | Carbohydrazide | 10 | .4:1 | 1.1:1 | 22 | — | — | — | — | 0.85 |
| | | 40 | 1.6:1 | 4.5:1 | 22 | — | — | — | — | 0.83 |
| 23 | p-Methylamine Phenol Sulfate | 40 | 43.1 | 4.5:1 | 22 | — | — | — | — | 0.54 |
| 24 | Tartaric Acid | 40 | 1.1:1 | 4.6:1 | 22 | — | — | — | — | 0.73 |
| 25 | Dimethyl Amino-2- | 45.6 | 1.5:1 | 4.9:1 | 22 | — | — | — | — | 0.0 |
| | Propanol | 39.6 | 1.9:1 | 6.3:1 | 36.7 | — | — | — | — | 0.0 |
| 26 | Sulfurous Acid | 20 | 1.6:1 | 4.1:1 | 51 | — | — | — | — | 0.0 |
| 27 | Thioglycolic acid | 40 | 3.1:1 | 8.9:1 | 51 | — | — | — | — | 7.5 |
| 28 | Diethyl Amino Ethoxyethanol | 39.2 | — | 4.7:1 | 30.3 | — | — | — | — | 0.93 |
| 29 | Dimethyl Amino Ethanol | 39.8 | 1.7:1 | 9.9:1 | 28.3 | — | — | — | — | 1.2 |
| 30 | Pyrogallol/Diethyl-Hydroxylamine | 20/34 | — | — | 33 | 86.1 | 92.9 | 94.3 | 94.4 | 94.0 |
| | | 10/17 | — | — | 31 | 56.7 | 60.2 | 61.5 | 61.3 | 61.3 |
| | | 20/34 | — | — | 48.3 | 99.6 | 99.6 | 99.6 | 99.6 | 99.6 |
| | | 10/17 | — | — | 51.8 | 86.8 | 91.6 | 94.1 | 94.9 | 95.3 |
| | | 5/8.5 | — | — | 49 | 42.4 | 58.2 | 55.2 | 59.1 | 62.8 |
| 31 | Cobalt/Pyrogallol | .6/20 | — | — | 32.6 | 83.3 | 83.5 | 82.2 | 80.5 | 78.9 |
| 32 | Hydroquinone/Pyrogallol | 100/10 | — | — | 50 | 98.8 | 99.0 | 98.8 | 98.7 | 98.5 |
| | — | 50/.5 | — | — | 50 | 99.4 | 99.5 | 99.4 | 99.4 | 99.3 |
| | | 10/.1 | — | — | 50 | 44.9 | 50.9 | 55.0 | 56.9 | 57.7 |
| | | 20/.2 | — | — | 50 | 98 | 98.8 | 98.5 | 98 | 97.7 |
| | | 7.5/.075 | — | — | 49.1 | 33.7 | 38.9 | 43.0 | — | 46.9 |
| | | 20/.1 | — | — | 50.3 | 95.6 | 98.2 | 98.1 | 97.5 | 96.8 |

*Examples 15 through 29 are Comparison Examples.

EXAMPLE 33

Although the traditional method of measuring the effectiveness of oxygen scavengers as boiler water corrosion inhibitors has been to measure the relative speed with which they react with dissolved oxygen, such results can be misleading. This is true because, in operating systems, oxygen is an intermediary in the corrosion reaction and the first product of corrosion is ferric oxide. Oxygen alone would not necessarily be detrimental were it not for this corrosion reaction. The primary function of an oxygen scavenger may therefore be to reduce ferric ions to their original state. Under such conditions, it is the iron specie itself that is the primary "oxygen scavenger"; the dosing agent functions primarily as a reducing agent for ferric ions.

Accordingly, a test procedure was used to measure the relative effectiveness of boiler corrosion inhibitors with respect to their ability to reduce ferric ions This procedure compared the time required for equal molar concentrations of reducing agents to reduce a constant ferric concentration to a specified level. Thus, the reducing agents being tested were reacted with a ferric standard in a test cell. The sensing head of a Brinkman Colorimeter Model PC/800, set at 520 nanometers, was placed in the cells. The drop in ferric ion concentration was continuously recorded using a Brinkman Servogor Model 210 set at 12 cm/minute. Using the data obtained, curves showing time in minutes on the ordinate versus percent absorbance on the abscissa were developed. The negative slopes of these curves are indirectly proportional to the relative effectiveness of their respective reducing agents. The most effective inhibitor evaluated was pyrogallol, which had an inverse slope of 10.0. The least effective inhibitor was sodium sulfite, which had an inverse slope of 1.2. These results are shown in Table IV, below.

TABLE IV

| Relative Effectiveness Negative Slope of Reduction Rate* | |
|---|---|
| Hydroquinone | 2.7 |
| Pyrogallol | 10.0 |
| Hydroquinone/Pyrogallol | 3.3 |
| Erythorbic Acid | 6.7 |
| Hydrazine | 1.8 |
| Sodium Sulfite | 1.2 |

*All compounds evaluated were at $0.18 \times 10^{-3}$ .g-moles/l.
+Hydroquinone/pyrogallol composition was 95:5 wt:wt% hydroquinone:pyrogallol.

What is claimed is:

1. A method of inhibiting corrosion in boilers comprising adding to boiler feedwater containing oxygen an effective amount of a hydrazine-free composition comprising: a) pyrogallol and b) hydroquinone; wherein the weight ratio of a):b) ranges from about 99.1 to 1:99.

2. A hydrazine-free corrosion inhibiting composition comprising: a) pyrogallol, b) hydroquinone and c) water; wherein the dosage of b) ranges from about 0.1 ppm to about 1,000 ppm of c) and; wherein the weight ratio of a):b) ranges from about 99:1 to 1:99.

* * * * *